US007155770B2

(12) United States Patent
Anderson et al.

(10) Patent No.: US 7,155,770 B2
(45) Date of Patent: Jan. 2, 2007

(54) CLEANING IMPLEMENT HAVING A SCRAPER AND A PIVOTING SQUEEGEE WITH BROOM

(75) Inventors: Torrence Anderson, Overland Park, KS (US); Lyle Rosine, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 661 days.

(21) Appl. No.: 10/464,401

(22) Filed: Jun. 16, 2003

(65) Prior Publication Data

US 2004/0250365 A1 Dec. 16, 2004

(51) Int. Cl.
*A47L 1/06* (2006.01)
*A47L 13/12* (2006.01)

(52) U.S. Cl. ..... 15/111; 15/117; 15/144.1; 15/144.4; 15/172; 15/236.02

(58) Field of Classification Search ..... 15/111, 15/117, 144.4, 172, 245, 247, 144.1, 236.02
See application file for complete search history.

(56) References Cited

U.S. PATENT DOCUMENTS 1,439,913 A * 12/1922 Saxe ..... 15/172
1,468,431 A * 9/1923 Wodonos ..... 401/150
2,047,613 A * 7/1936 Brown ..... 403/97
2,799,037 A * 7/1957 Grogan ..... 15/172
3,051,975 A 9/1962 Schwartz
3,307,212 A 3/1967 MacInnes
3,724,017 A 4/1973 Malloory
3,968,535 A 7/1976 Nichols, Jr.
4,040,140 A 8/1977 Hopkins et al.
D246,414 S 11/1977 Hopkins et al.
D260,959 S 9/1981 Schnarr
D265,269 S 7/1982 Frantz
4,403,623 A * 9/1983 Mark ..... 15/167.1
D271,149 S 10/1983 Castiglione
D279,228 S 6/1985 Peterson
4,673,307 A * 6/1987 Prestele et al. ..... 401/289
D291,611 S 8/1987 Toth
D292,532 S 10/1987 Strongwater
4,719,660 A 1/1988 Hopkins
4,776,716 A 10/1988 Huang
4,813,458 A 3/1989 Jacobucci
D305,468 S 1/1990 Yonkers
4,908,900 A 3/1990 McLaughlin et al.
4,939,807 A 7/1990 Hencz
D317,669 S 6/1991 Farmer
5,077,856 A 1/1992 Freundl
5,099,540 A 3/1992 Paschetto
5,255,406 A 10/1993 Rood
5,263,222 A 11/1993 Johnstone, II
D345,640 S 3/1994 Galati
5,349,716 A 9/1994 Millar
D364,720 S 11/1995 Francis et al.
D372,349 S 7/1996 Adair
D374,525 S 10/1996 Kleinpell, II et al.

(Continued)

*Primary Examiner*—Randall Chin
(74) *Attorney, Agent, or Firm*—McHale & Slavin

(57) ABSTRACT

A tool for removing ice, snow and other debris from a vehicle or other surface has an extension handle with telescoping ends. On one end of the handle there is an oblong head carrying a broom on one surface and a squeegee on the opposite surface. The head is rotatably mounted on the handle to provide both a linear cleaning motion and an arcuate motion. On the other end of the handle is a bifurcated extension carrying a scraper and a toothed cutter.

11 Claims, 6 Drawing Sheets

U.S. PATENT DOCUMENTS

| | | | | |
|---|---|---|---|---|
| D376,881 | S | | 12/1996 | Kleinpell et al. |
| 5,606,761 | A | * | 3/1997 | Lynch ..... 15/144.4 |
| D381,149 | S | | 7/1997 | Mayo |
| 5,680,668 | A | | 10/1997 | Kim |
| D392,784 | S | | 3/1998 | Hellinger et al. |
| D394,923 | S | | 6/1998 | Hellinger et al. |
| D396,910 | S | | 8/1998 | Henke |
| 5,829,143 | A | | 11/1998 | Gilliam |
| 5,836,041 | A | | 11/1998 | Kleinpell, II et al. |
| D405,573 | S | | 2/1999 | Tisbo et al. |
| D405,930 | S | | 2/1999 | Tisbo et al. |
| D410,122 | S | | 5/1999 | Hellinger et al. |
| D411,043 | S | | 6/1999 | Wachler et al. |
| D415,325 | S | | 10/1999 | Hellinger et al. |
| D417,049 | S | | 11/1999 | Hughes et al. |
| 6,018,836 | A | | 2/2000 | Williams |
| D422,146 | S | | 4/2000 | Sneed et al. |
| D424,767 | S | | 5/2000 | Shea |
| D441,156 | S | | 4/2001 | Zegman |
| D441,510 | S | | 5/2001 | Zegman |
| 6,243,906 | B1 | | 6/2001 | Holliday et al. |
| D453,248 | S | | 1/2002 | Wachler et al. |
| D453,250 | S | | 1/2002 | Kleinpell |
| D456,576 | S | | 4/2002 | Philipson |
| D459,847 | S | | 7/2002 | Ingram |
| D464,183 | S | | 10/2002 | Fritsche |
| 6,481,041 | B1 | | 11/2002 | Ingram |

* cited by examiner

CLEANING IMPLEMENT HAVING A SCRAPER AND A PIVOTING SQUEEGEE WITH BROOM

BACKGROUND OF THE INVENTION

1. Field of the Invention

This invention relates to a safety device for cleaning debris, such as ice and snow, from surfaces, including vehicles, to provide better visibility.

2. Description of the Prior Art

There are many different prior art ice and snow scrapers for clearing the surfaces of a car or truck. For the most part, these scrapers have a handle portion with a blade mounted or formed on one end. Some devices have a handle with a blade on one end and a broom on the other for removal of ice and snow.

The Ingram patent, U.S. Pat. No. 6,481,041, discloses a tool with a scraper on one end and a pivoting brush on the other end.

U.S. Pat. No. 6,243,906 discloses such a two ended handle with a broom and scraper mounted on opposite ends.

U.S. Pat. No. 4,939,807, discloses a scraper and broom for removing snow from a car. The broom and scraper are at the same end of the handle mounted 180 degrees about the end of the handle.

McLaughlin et al, U.S. Pat. No. 4,908,900, disclose another cleaning tool within extendable handle having a scraper on one end and a pivoting brush on the other.

U.S. Pat. No. 4,776,716 to Huang discloses a mop or squeegee mounted on one end of a handle to be pivotable about a 90 degree arc.

U.S. Pat. No. 3,968,535, discloses a general purpose cleaning tool with a brush, scraper a squeegee mounted on one end of a handle.

Other representative known prior art ice scrapers include U.S. Pat. Nos. 6,018,836; 5,829,143; 5,539,949; 5,349,716; 5,255,406; 5,077,856; 4,719,660; 5,263,222; 5,099,540; 3,968,535; 3,724,017; 3,307,212; 3,051,975.

What is needed in the art is a tool having an adjustable length handle with a scraper on one end and a pivotable combination wiper blade and brush or squeegee on the other end for use by smaller individuals and/or on larger vehicles.

SUMMARY OF THE PRESENT INVENTION

A cleaning tool for removing ice, snow and other debris from a vehicle or other surface. The cleaning tool has a handle, which may be extendable by use of a telescoping end. On one end of the handle there is an oblong head carrying a broom on one surface and a squeegee on the opposite surface. The head is rotatably mounted on the handle to provide both a linear cleaning motion and an arcuate motion. On the other end of the handle is a bifurcated extension carrying a scraper and a toothed cutter.

Therefore, an objective of this invention is to provide a single tool that combines an ice scraper, a broom, a squeegee and a wiper blade to be used in a push—pull motion or an arcuate motion by pivoting the broom.

Another objective of the invention is to provide an adjustable handle length so that the implements may be extended from the user to access distant surfaces of a vehicle.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
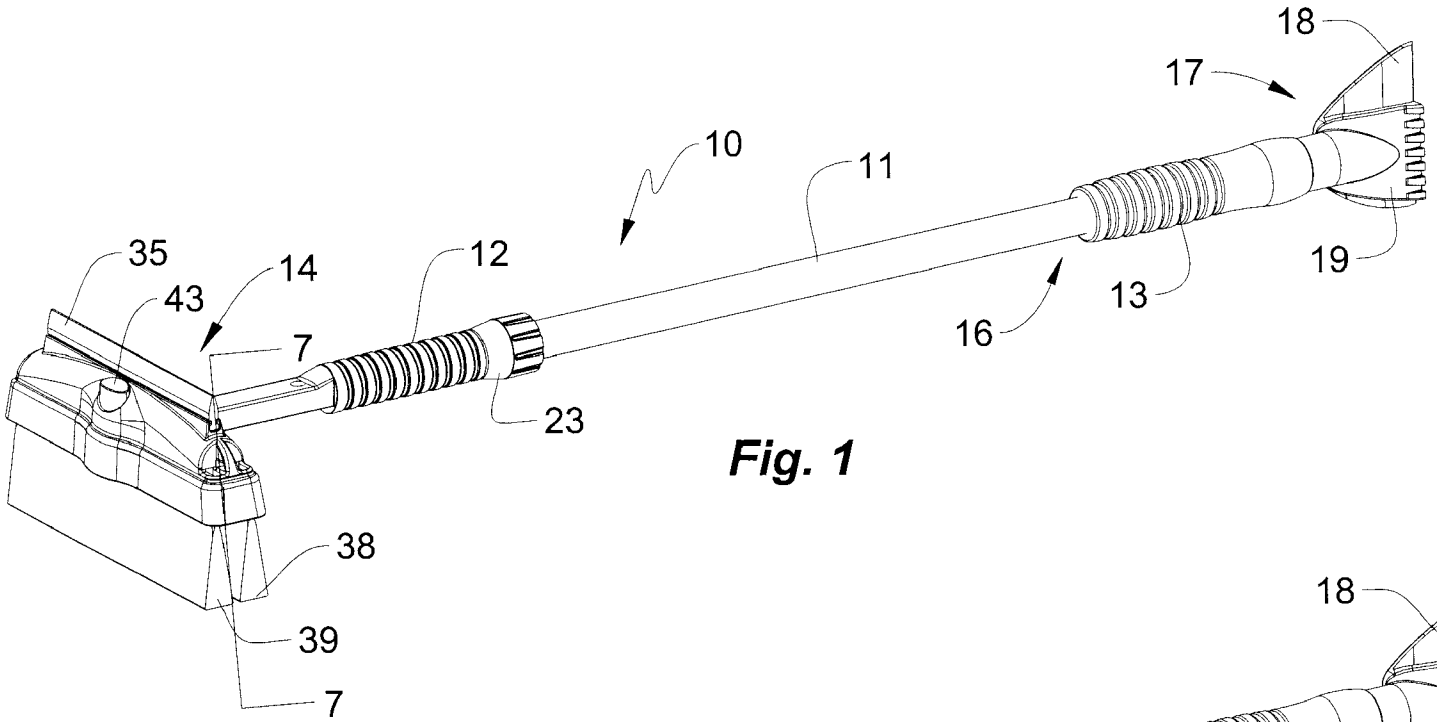
FIG. 1 is a perspective of the tool of this invention showing the head perpendicular to the handle.

The snow and ice remover 10, has a handle 11 with a front hand grip 12 and a rear hand grip 13. Near the front hand grip 12 there is a head 14. The head 14 can rotate about the front end 15 of the handle from a position perpendicular to the handle, as shown in FIG. 1, to a parallel position, shown in FIG. 2.

Figure 3:
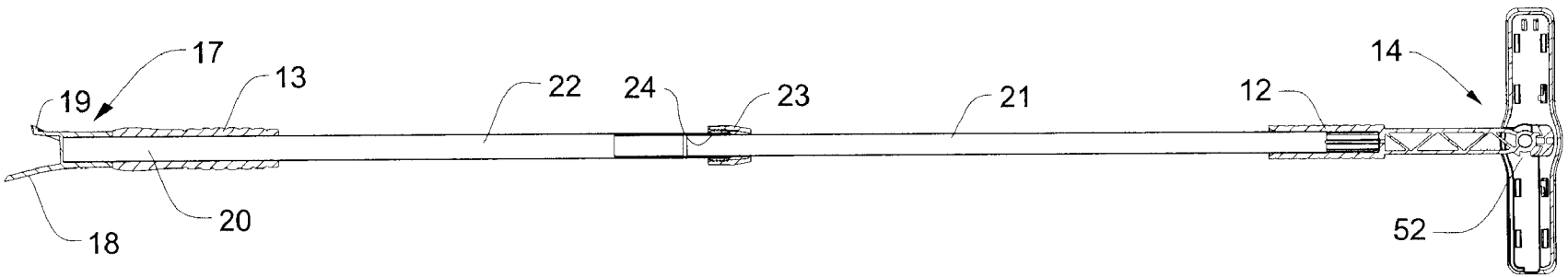
FIG. 3 is a cross section tool with the handle extended.
Figure 4:
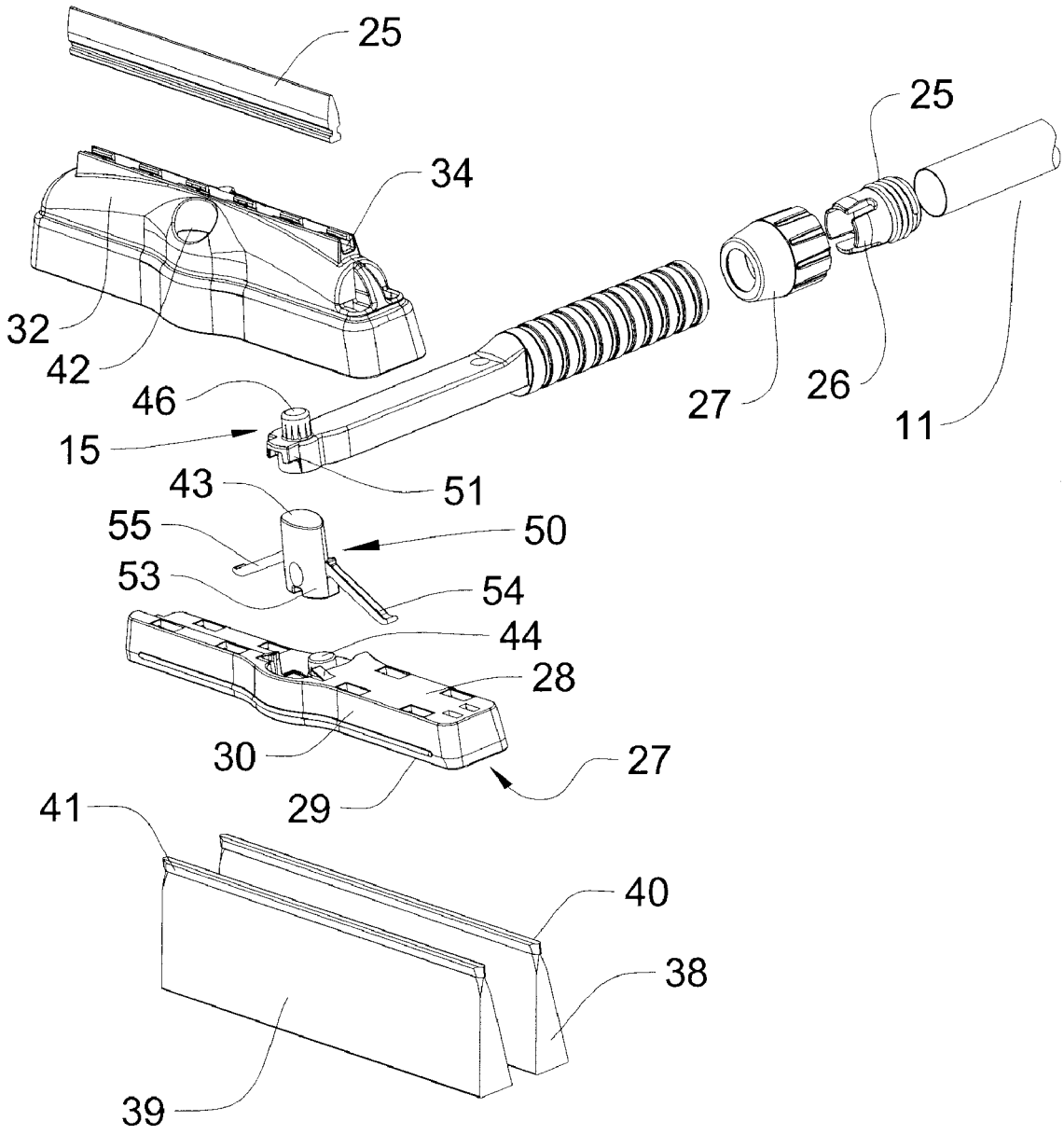
FIG. 4 is an exploded view of the head of the tool of this invention.

Near the rear grip 13, there is a bifurcated extension 17 mounted on the rear end 16 of the handle. One side of the bifurcation 17 terminates in a knife edge scraper 18. The other side of the bifurcation terminates in a toothed cutter 19. As shown in FIG. 3, the bifurcated extension 17 has a bore 20 into which the rear grip 13 is inserted for assembly. As shown in FIG. 3, the rear grip 13 has a bore for receiving the rear end 16 of the handle. In this embodiment, the bifurcated extension 17 may or may not be part of the assembly.

Figure 2:
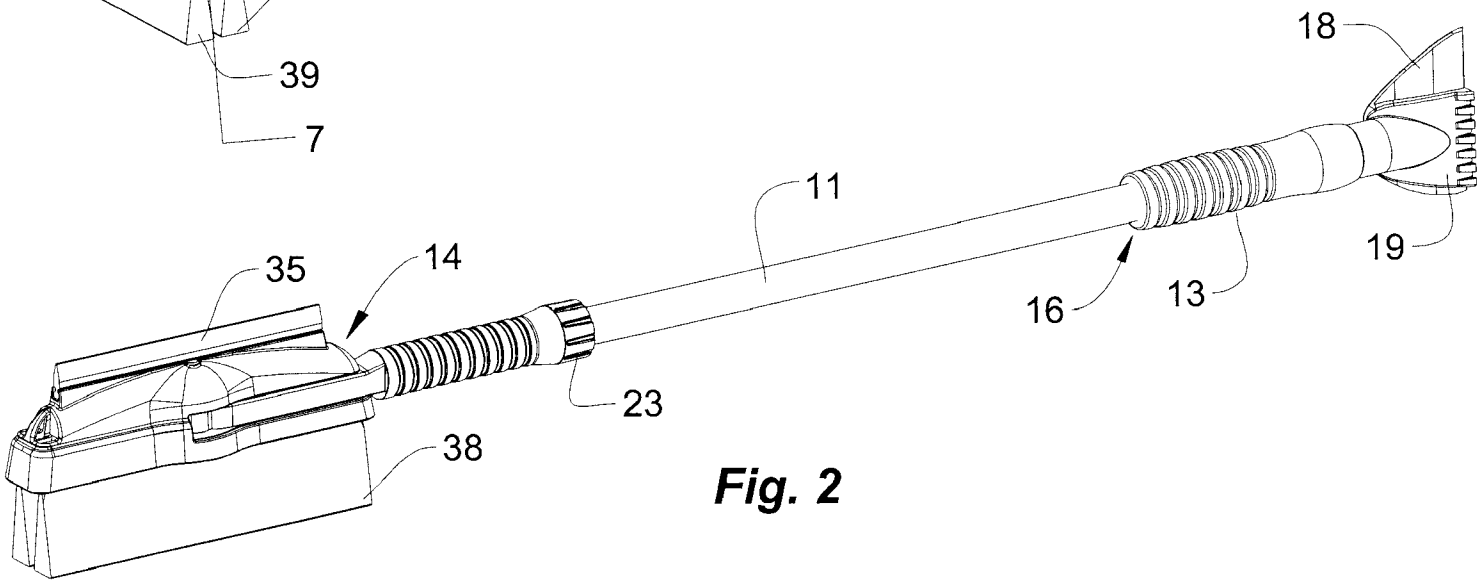
FIG. 2 is a perspective of the tool of FIG. 1 with the head parallel to the handle.

Alternatively, the rear grip 13 and the bifurcated extension 17 may be one piece and telescope onto the rear end 16, as shown in FIG. 1.

According to the embodiment shown in FIG. 3, the handle 11 has a forward section 21 and a rear section 22. One section has a smaller diameter than the other so that these sections telescope together to shorten or extend the length of the handle. As shown in FIG. 3, for illustration and not limitation, the forward section 21 telescopes into the rear section 22. This orientation could be reversed, if desired. A friction nut 23 is mounted on the leading end of the rear section 22 of the handle, as shown in FIG. 3, to temporarily fix the desired length of the handle. The friction nut has an inner tubular portion 24 permanently attached to the handle 11. The tubular portion 24 has external threads 25 and flexible fingers 26 extending beyond rear section 22 the handle. The friction nut 23 has internal threads and a tapered portion 27. The forward section 21 of the handle is telescoped through the friction nut into the rear section 22 of the handle. As the friction nut is tightened on the threads the tapered portion reduces the circumference of the fingers 26 to grip-the front section 21 the handle.

The head 14 has an oblong base 27 with a top surface 28, a bottom surface 29 and a sidewall 30. The sidewall 30 has a gap 31 extending from the center of the base through one side and one end to receive a portion of the handle when the head is in a parallel position with reference to the longitudinal axis of the handle. The bottom surface of the head has parallel slots 36 and 37 into which brooms 38 and 39 are inserted and secured. The spines 40 and 41 fit into an enlarged portion of the slots while the bristles extend through a narrowed opening.

The top surface 28 has a hub 44 extending outwardly from a larger depression near the approximate center. The hub 44 rotatably engages the front end 15 of the handle 11. A head cover 32 fits over the top surface 28. The head cover 32 has prongs that fit into the openings 33 in the top surface 28 of the head. Alternatively, the head cover may form a friction fit about the periphery of the head 14. The head cover has a slot 34 along the length for receiving a wiper blade or squeegee 35. The head cover also has an opening 42 through which a portion of the latch mechanism 50 protrudes. The button 43 reciprocates when a user manually presses on it. A dome shaped cavity 45 is formed in the interior of the head cover near the center, as shown in FIGS. 6 and 7.

Figure 5:
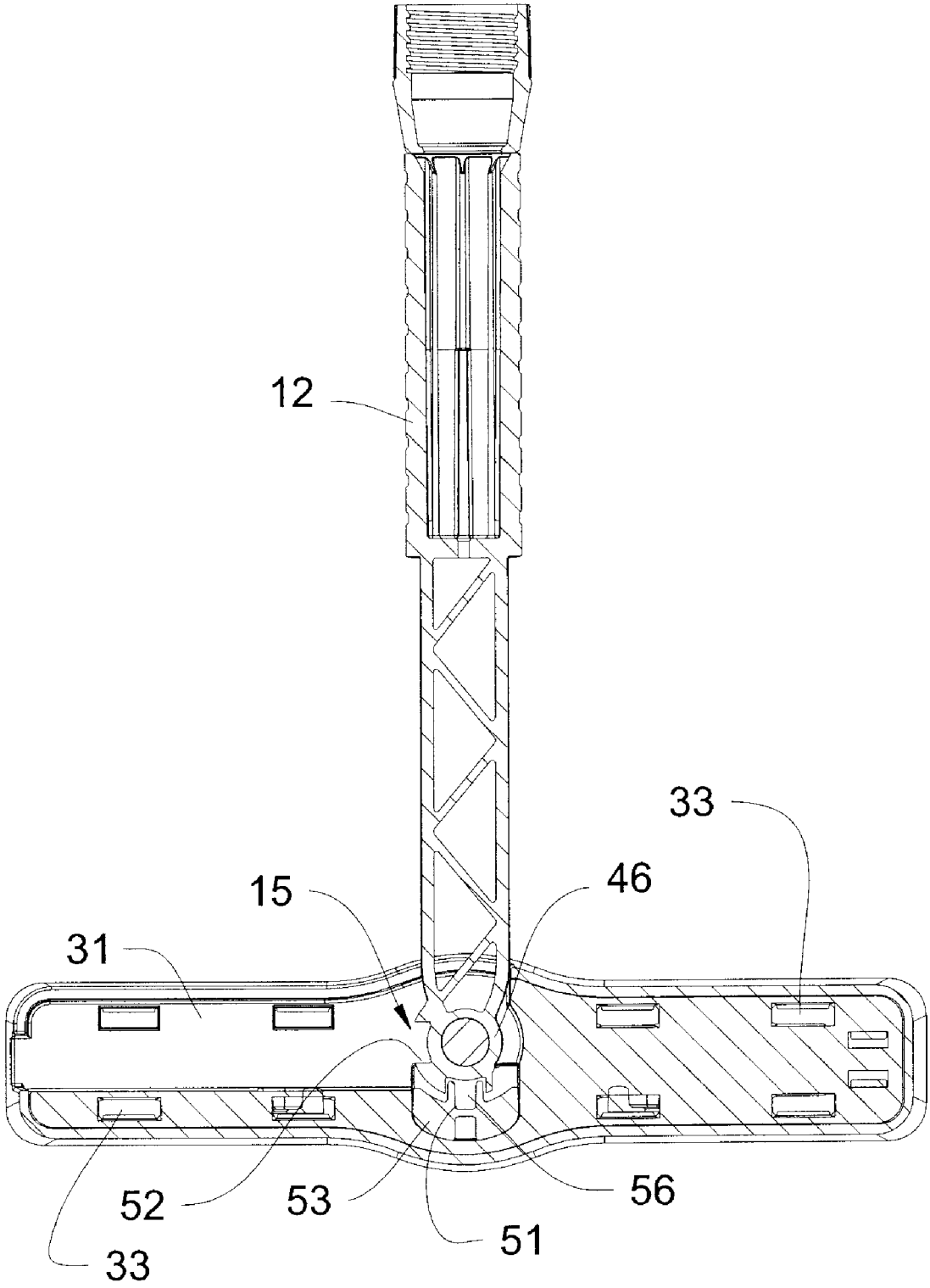
FIG. 5 is a partial horizontal cross section of FIG. 1.
Figure 6:
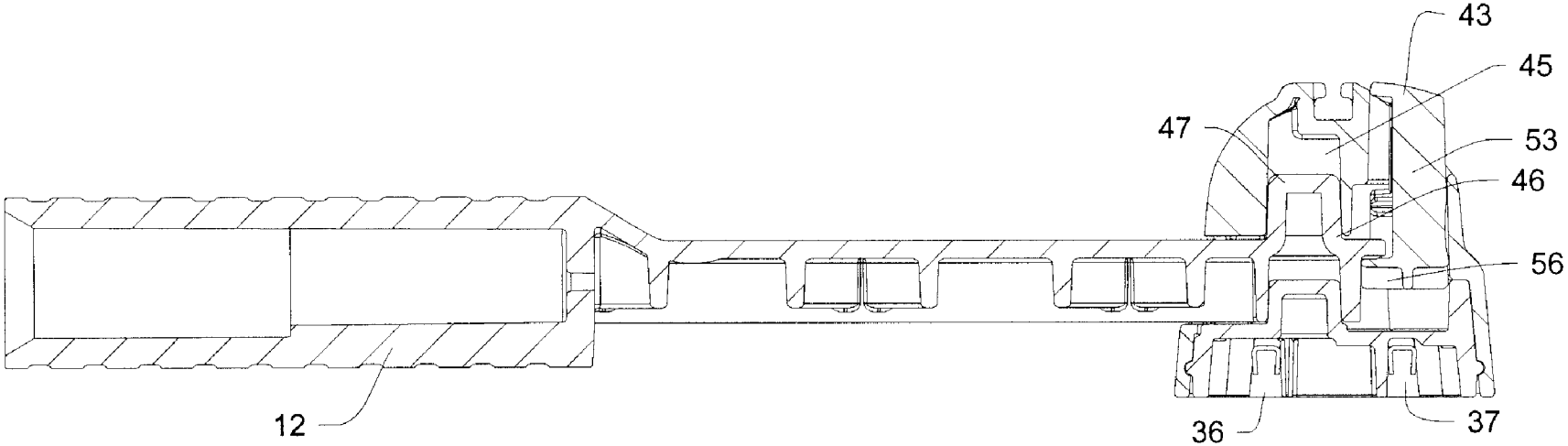
FIG. 6 is a partial vertical cross section of FIG. 1.
Figure 7:
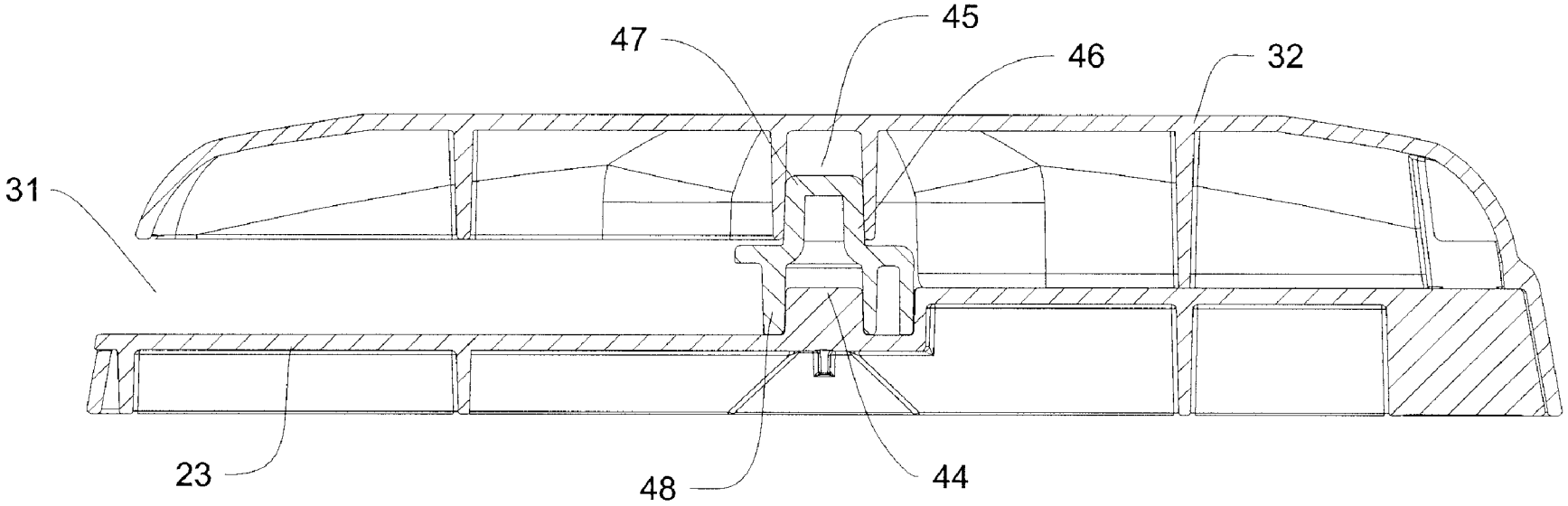
FIG. 7 is a cross section along line 7—7 of FIG. 1.

The front end 15 of the handle 11 is formed with tubular fitting 46 normal to the longitudinal axis of the handle, also shown in FIGS. 5–7. The upper end 47 of the tubular fitting 46 rotatably engages the dome shaped cavity 45 of the head cover 32. The lower end 48 accepts the hub 44 on the top surface 28 of the head 14. The tubular fitting 46 has two notches about the circumference, as shown in FIG. 5. One notch 51 is at the forward side of the tubular fitting in line with the longitudinal axis of the handle. The other notch 52 is displaced 90 degrees about the circumference of the tubular fitting.

The latch mechanism 50 has a semi-circular body 53 formed with a button 43 on the top. On the sides of the latch mechanism at about 180 degrees apart, resilient arms 54 and 55 protrude laterally and downwardly below the bottom of the latch mechanism. These arms engage the top surface 28 of the head and provide spring bias forcing the button through the opening 42. Also, on the body 53 there is a tooth 56 disposed about 90 degrees from the arms 54 and 55. The semi-circular body 53 is shaped to partially surround the forward end 15 of the handle. The tooth 56 engages the notch 51.

To rotate the head 11 from a perpendicular position to a parallel position, relative to the longitudinal axis of the handle 14, the operator or user pushes on the button 43 reciprocating the latch mechanism body into the larger depression about the hub 44. This moves the tooth 56 downwardly below the bottom of the notch 51 freeing the latch mechanism. The head can be rotated, with the button 43 remaining depressed, to the parallel position. The button is then released and the spring biased arms 54 and 55 reciprocate the latch mechanism body upwardly engaging the tooth 56 with notch 52. The broom and squeegee are now in a position to be used in an arcuate motion to clear the selected surface.

A number of embodiments of the present invention have been described. Nevertheless, it will be understood that various modifications may be made without departing from the spirit and scope of the invention. Accordingly, it is to be understood that the invention is not to be limited by the specific illustrated embodiment but only by the scope of the appended claims.

What is claimed is:

1. A combination tool for removing extraneous material from a surface comprising an handle having a first end, a second end and a shaft, said shaft having a first piece connected to said first end and a second piece connected to said second end, said first piece and said second piece slidably connected and movable relative to each other to shorten and lengthen said handle, said first end terminating in a tubular fitting normal to the longitudinal axis of said handle, said tubular fitting having two notches disposed approximately 90 degrees from each other about the circumference, an oblong head having a hub disposed in said tubular fitting for rotation about said tubular fitting, said head carrying a broom, a head cover frictionally engaging said head opposite said broom, said head cover having a dome shaped cavity rotatably connected to said tubular fitting, said head cover including a slot carrying a squeegee and an opening, a semi-circular latch mechanism rotatably disposed about said tubular fitting, said latch mechanism having a spring biased button in said opening, a tooth fixed to said latch mechanism and engaging one of said notches whereby pressure on said button moves said tooth out of said notch and allows rotation of said head approximately 90 degrees and releasing said pressure moves said tooth into said other notch.

2. The combination tool of claim 1 further comprising said second end of said shaft terminating in a bifurcated extension, including a scraper and a cutter.

3. A tool for removing debris from a vehicle comprising;

a handle with two ends and having a longitudinal axis, an oblong head, a latch mechanism constructed and arranged to rotatably couple said head to one end of said handle, said handle having at least two notches approximately 90 degrees apart, said latch mechanism constructed and arrange to removably engage said notches to position said oblong head along an axis parallel or perpendicular to said longitudinal axis of said handle, said head having a bottom side and a top side, at least one groove in said bottom side of said head, a broom slidably received in said groove, a head cover attached to said head over said top side, said head cover having a slot with a wiper blade slidably received in said slot.

4. The tool of claim 3, further comprising said handle and said head being attached in the same plane, a gap formed in said head adapted to receive a portion of said handle when said longitudinal axis of said handle is parallel to said head.

5. The tool of claim 3 further comprising an aperture in said head cover, a portion of said latch mechanism extending through said aperture, whereby physical pressure on said portion of said latch mechanism results in said latch mechanism disengaging from one of said at least two notches permitting rotation of said head.

6. The tool of claim 5 further comprising a spring disposed between said latch mechanism and said head, said spring biasing said latch mechanism into engagement with said one of said at least two notches.

7. The tool of claim 5 further comprising said handle having two pieces, said pieces telescoping together to adjust the length of said handle.

8. The tool of claim 7 further comprising a bifurcated extension attached to the other end of said handle.

9. The tool of claim 3 further comprising said handle having two pieces, said pieces telescoping together to adjust the length of said handle.

10. The tool of claim 3 further comprising a bifurcated extension attached to the other end of said handle.

11. The tool of 10 further comprising said bifurcated extension terminating in a scraper and a cutter.

* * * * *